United States Patent [19]

Handleman et al.

[11] 4,234,273

[45] Nov. 18, 1980

[54] FLUIDIZABLE MATERIAL HANDLING APPARATUS

[76] Inventors: Avrom R. Handleman; Charles S. Alack, both of P.O. Box 13151, St. Louis, Mo. 63119

[21] Appl. No.: 16,517

[22] Filed: Mar. 1, 1979

Related U.S. Application Data

[62] Division of Ser. No. 801,865, May 31, 1977, Pat. No. 4,149,755.

[51] Int. Cl.[2] ..... B65G 53/36

[52] U.S. Cl. ..... 406/90; 52/2

[58] Field of Search ..... 403/5, 15; 285/260; 15/352; 52/2; 406/89, 90, 91, 138, 146

[56] References Cited

U.S. PATENT DOCUMENTS

| | | | |
|---|---|---|---|
| 2,911,237 | 11/1959 | Olson | 285/260 |
| 3,367,724 | 2/1968 | Emery et al. | 406/91 |
| 3,975,915 | 8/1976 | Haw | 52/2 X |
| 4,007,694 | 2/1977 | Fowler et al. | 406/90 |

*Primary Examiner*—Jeffrey V. Nase

*Attorney, Agent, or Firm*—Senniger, Powers, Leavitt and Roedel

[57] ABSTRACT

An improved material handling apparatus or container for transporting, storing, and unloading a load of powder, granular, particulate or other fluidizable material. The container has a pallet base which includes a discharge opening and an inclined load supporting deck with the discharge opening located at the lowermost portion of the deck at one side of the pallet whereby substantially all the fluidizable material in the container may be readily unloaded. The container includes a porous cloth diaphragm held in place overlying the deck by means of a retainer spline inserted into a groove in the pallet along with the diaphragm in such manner that the spline self-locks in the groove upon tension loading being applied to the diaphragm thus preventing the diaphragm from pulling free of the pallet during fluidization of the load. A vent valve is provided for maintaining pressure within the container during fluidization of the load within a predetermined pressure range to maintain shape and structure while the container is being unloaded without limiting the flow of fluidizing air but preventing excessive pressure from being applied to the bag. Another embodiment of the container is disclosed which lessens the danger of explosion or fire due to the discharge of static electricity while handling potentially dangerous materials or while operating in dangerous environments.

14 Claims, 9 Drawing Figures

FLUIDIZABLE MATERIAL HANDLING APPARATUS

This is a division, of application Ser. No. 801,865, filed May 31, 1977, now U.S. Pat. No. 4,149,755.

BACKGROUND OF THE INVENTION

This invention relates to material handling apparatus and more particularly to a pallet molded of synthetic resin material or the like adapted to form part of a container for transporting, supporting, and storing a load of fine granular, particulate, powdered or other fluidizable material, and for fluidized unloading of the load from the container.

The pallet of this invention represents an improvement over the container disclosed in the coassigned U.S. Pat. No. 4,007,694, and commercially available from the assignee of this invention, Semi-Bulk Systems, Inc. of St. Louis, Mo. under their registered trademark AIR PALLET. The pallet disclosed in the above-noted patent is generally circular, as viewed from above, having a number of legs spaced for the entrance of the tines of a forklift from any of four directions. The pallet has a peripheral wall extending around the pallet and an upwardly facing deck supported by the peripheral wall for supporting the load. The deck slopes downwardly toward one side of the pallet and is adapted to have a porous diaphragm of cloth or the like secured thereto with the diaphragm covering the deck. An outlet opening is provided in the peripheral wall of this prior art pallet above the level of the deck at the lowest side thereof through which the powdered load may be discharged or unloaded. An inlet opening also extends through the peripheral wall for introducing compressed air into the space between the diaphragm and the deck. The compressed air flows upwardly through the porous diaphragm for fluidizing the powdered load bearing against the diaphragm.

The prior art container described in the above-mentioned patent had a tubular plastic film bag secured to its pallet. This bag was generally of the same diameter as the pallet (e.g., about 42 inches in diameter) and was of sufficient height to contain a desired quantity of powder (e.g., 500–4,000 pounds or more). The bag was typically attached to the peripheral wall of the pallet by means of a metal strap band on the outside of the bottom of the bag, tightened therearound and secured in place. Typically, this strapping band was of the well known type (nylon) used to band shipping containers commercially available from Signode Corporation of Chicago, Ill. and other companies. Upon pressurizing the interior of the bag during fluidized unloading of the load, the air pressure would, on occasion, pull the bag from between the strap and the pallet with the resultant loss of fluidization air and spillage of the powdered load. Although this rarely occurred, it was a serious problem when it did occur because the escaping powder often prevented resealing of the bag to the pallet and thus the load could not be fluidized for unloading and would continue spilling from the container. It was also recognized that because the pallet was preferably molded of synthetic resin material, it suffered from some degree of inherent dimensional instability and it would relax when a strap was tightly applied therearound.

SUMMARY OF THE INVENTION

Among the several objects and features of the present invention may be noted the provision of a material handling container or pallet adapted to support a load of granular, particulate, powder, or other fluidizable material and adapted to fluidize the load for efficient and rapid discharge of substantially all the load from the container leaving little residue therewithin, the pallet having a plastic film or other flexible bag readily secured thereto for containing the load, the bag being secured to the pallet in such manner that the bag resists being pulled from the pallet during fluidization of the load and that the bag is effectively sealed relative to the pallet to prevent leakage of the load; the provision of such a pallet in which the bag may be readily secured to the pallet without damage to the bag or the pallet and with a minimum amount of labor required; and the provision of such a pallet with a container which is safe in handling materials which may explode or ignite when exposed to open static electricity sparks.

In general, the invention involves means for sealably securing the bag to the pallet and for preventing air pressure from within the bag present during fluidization of the load from pulling the bag from the pallet. The pallet has a continuous, outwardly projecting flange around its peripheral wall and the bag has its lower end folded on itself to form a hem and a cord is disposed within the hem, the hem fitting over the outside of the flange. The means securing the bag to the pallet comprises a hoop clamp which fits over the flange on the outside of the hem. The clamp includes means for circumferentially tightening the clamp on the hem and on the pallet for sealingly clamping the bag to the pallet whereby upon pressurization of the bag during fluidization of the load and upon the bag being pulled upwardly by the air pressure therewithin, the cord engages the clamp and prevents the bag from slipping relative to the clamp and to the pallet.

Other objects and features of this invention will be in part apparent and in part pointed out hereinafter.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
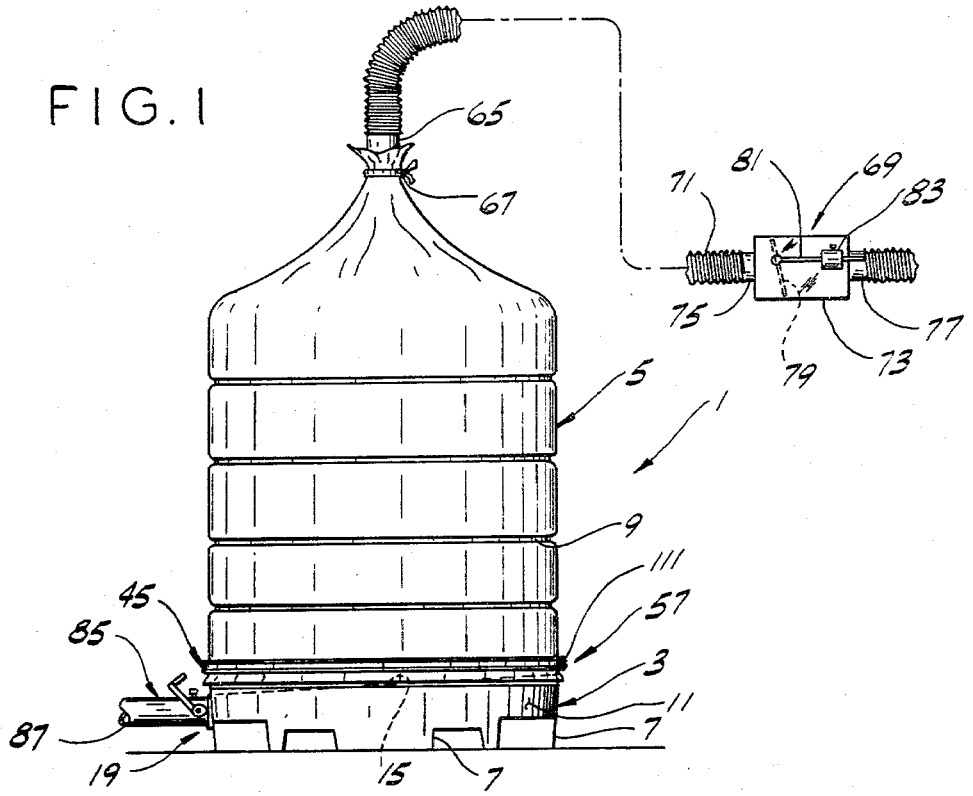
FIG. 1 is a side elevational view of a material handling container or pallet of this invention for fluidized unloading of fluidizable material.

Referring now to the drawings, a container of this invention for transporting, storing, and unloading a load of powder, granular, particulate or other fluidized material is indicated in its entirety at reference character 1 and is shown to include a one-piece pallet base 3, preferably molded of a suitable synthetic resin material (e.g., polyethylene or nylon), and a tubular bag 5 or other enclosure secured to the pallet for defining a storage space therewithin in which a load of fluidizable material is contained. The pallet includes a plurality of legs 7 (for example, 12 legs) engageable with the ground for supporting the container and the load therewithin, the legs being spaced to receive the lifting tines (not shown) of a forklift so that the loaded containers may be readily moved about. The bag may be of any suitable material, such as a limp coated fabric, or other air impervious limp sheet material, but it is preferably of a tough, strong plastic film as will be hereinafter specified. As indicated in FIG. 1, circumferential straps 9 may be optionally installed around the bag during or after filling to provide additional circumferential support for the bag. The quantity of material constituting a load may vary greatly depending on the material and container size. In many instances, the container of this invention is used primarily to transport and store so-called "semi-bulk" quantities of material (i.e., more than a bag full but less than a truck or railroad car full of fluidizable material).

Figure 3:
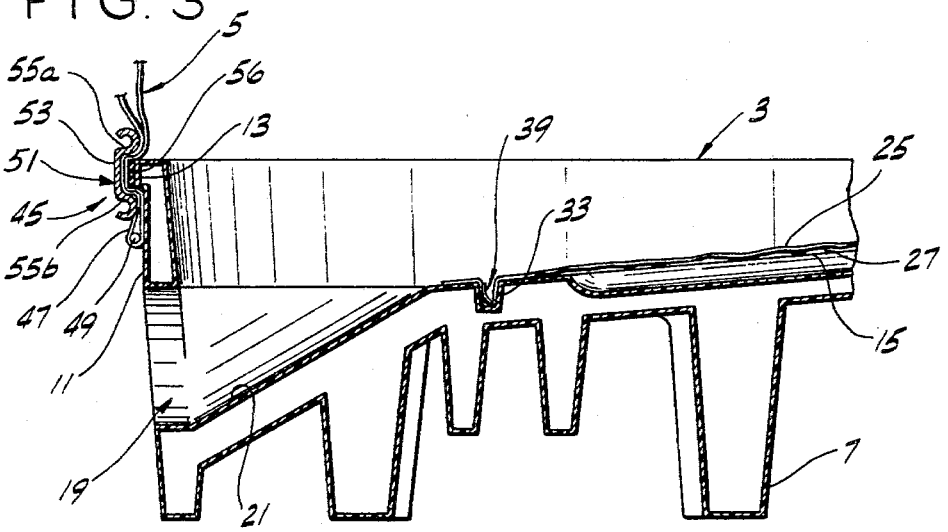
FIG. 3 is an enlarged cross-sectional view taken along line 3—3 of FIG. 2 showing the discharge outlet of the container.

As is best shown in FIGS. 1 and 3, pallet 3 includes an outer, generally vertical peripheral wall 11 defining the outside of the pallet. An outwardly projecting, continuous flange 13 extends around the pallet at the top of wall 11 for purposes as will appear. The pallet further includes a generally planar load supporting deck 15 inclined downwardly toward one side of the pallet relative to the lower ends of legs 7. As is shown in the drawings, pallet 3 is preferably a hollow, unitary molded plastic structure and is preferably fabricated by well known rotational molding techniques. It will be understood, however, that the manner in which pallet 3 is fabricated and specific details of its structure may be varied significantly and still be within the scope of this invention. As disclosed in the above-discussed coassigned U.S. Pat. No. 4,007,694, the load supporting deck 15 of the present invention is preferably spaced from supports formed within the pallet and is flexible or deformable under the weight of the load supported thereby so as to deflect downwardly thereby to rest on supports so that the weight of the load is transferred to legs 7 and so that the deck need not resist the entire weight of the load supported thereby.

Pallet 3 further has an outlet opening, generally indicated at 19, at the side of the pallet adjacent the lowermost edge of inclined deck 15 extending from the space above the deck through peripheral wall 11 for the discharge of material within the container. This discharge opening is defined by conduit walls 21 through the peripheral wall. The outlet is adjacent the lowermost portion of deck 15 and is generally flush with the deck and angles downwardly from its inner end below the level of the deck toward the inlet end of the outlet and thence down and out of the container via the outlet. The pallet further includes a second opening constituting an inlet 23 for the introduction of compressed air or other gas fluidizing the load in a manner that will appear.

Figure 2:
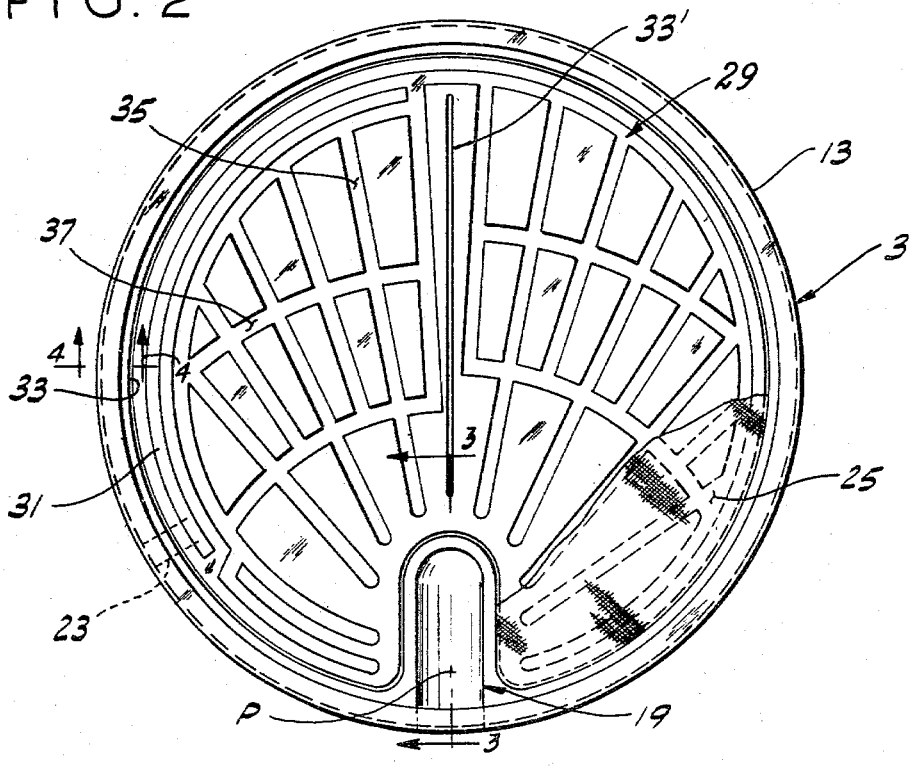
FIG. 2 is an enlarged plan view of the pallet base of the container of this invention illustrating a discharge outlet for the fluidized load, an air inlet, an air distribution network in the upwardly facing deck of the pallet, and a porous diaphragm overlying the deck.

Pallet 3 further includes a porous diaphragm 25 overlying deck 15 with a space between the diaphragm and the deck constituting a plenum chamber 27. Compressed air or other gas introduced via inlet 23 enters the plenum and passes through the porous diaphragm so as to fluidize the load of fluidizable material within bag 5 bearing on the diaphragm. Deck 15 includes a plurality of upwardly facing open grooves or channels constituting an air distribution network, as generally indicated at 29, for substantially uniformly distributing air pressure within plenum 27 beneath diaphragm 25 to facilitate uniform fluidization of the load over the entire working area of the diaphragm. This air distribution network includes a main air channel 31 in communication with air inlet 23. The main air channel extends around the outer margin of deck 15 and, as shown in FIG. 2, the outer margin of diaphragm 25 overlies the main air channel and an outer circumferential retainer groove 33. The air distribution network still further includes a plurality of secondary air channels 35 radiating from a common point or locus P and intersecting the main air channel 31 at substantially equal intervals therealong. The air distribution network includes a plurality of tertiary air channels 37, these tertiary air channels being shown to be curvilinear and to intersect the secondary air channels 35. The common point P is located adjacent outlet opening 19 and the secondary air channels 35 radiate therefrom. The common point P is also shown to be the common center of the curvilinear tertiary air channels 37. Main air channel 31 is of a depth substantially greater than the secondary air channels and the other air channels are so sized relative to one another as to facilitate equal distribution of air pressure from one channel to another, especially upon initial introduction of compressed air into plenum 27 when the diaphragm is pushed down under the weight of the load against deck 15.

Figure 4:
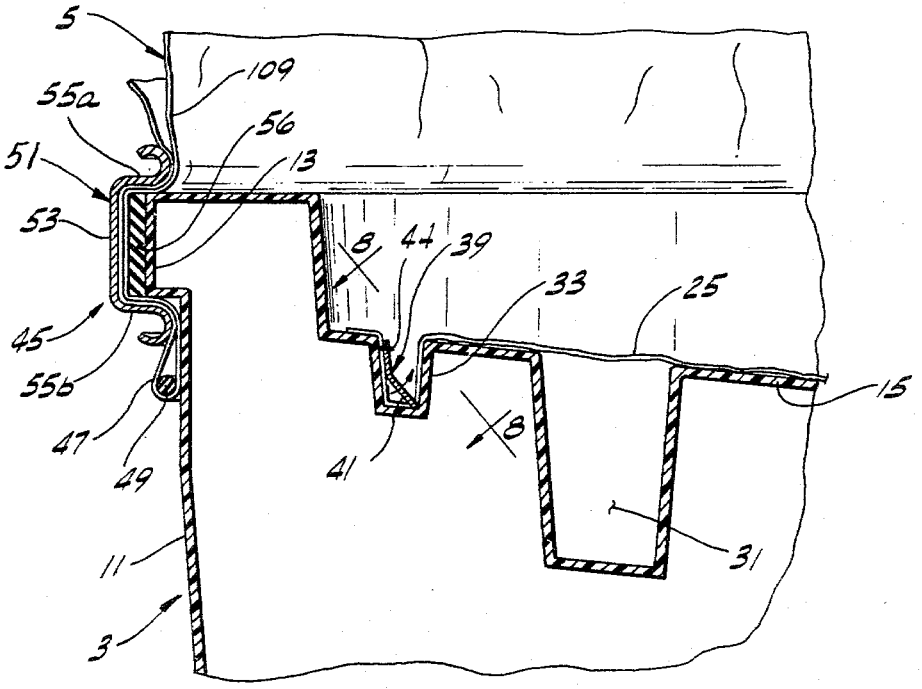
FIG. 4 is an enlarged cross-sectional view taken along line 4—4 of FIG. 2 illustrating means in accordance with this invention for securing the diaphragm to the pallet and means for securing the bag to the pallet.
Figure 5:
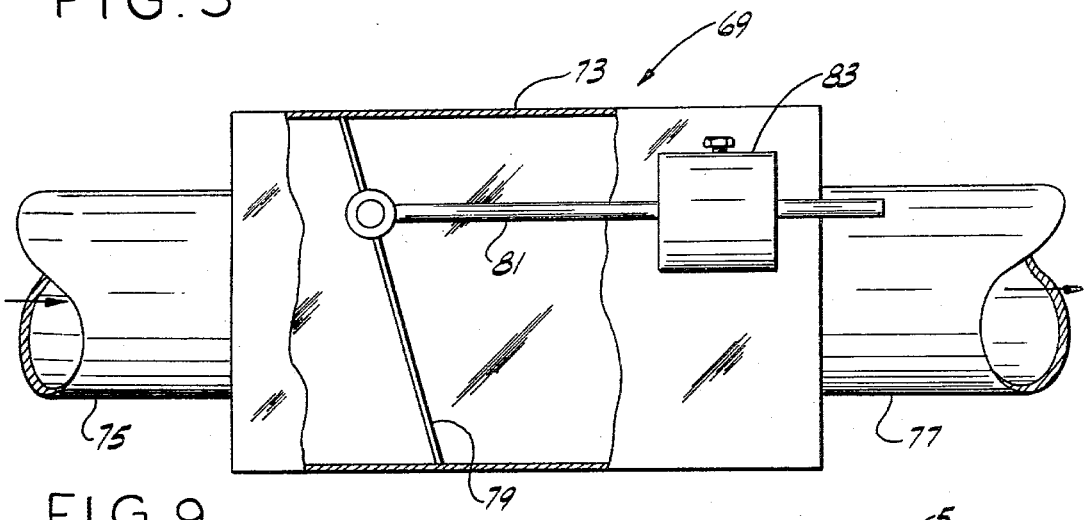
FIG. 5 is an enlarged side elevational view with parts broken away of a valve of this invention for venting the container and for maintaining the pressure of the fluidizing air within the container within a predetermined pressure range during fluidization of the load.
Figure 8:
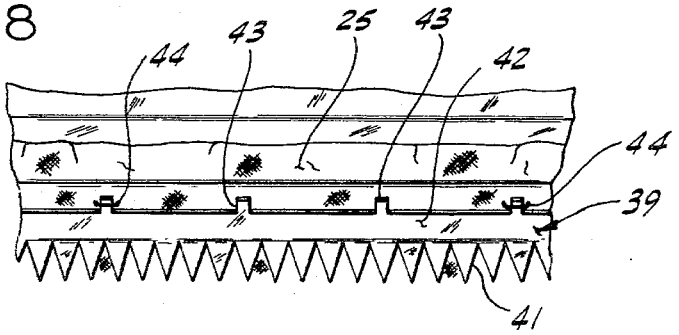
FIG. 8 is a view taken along line 8—8 of FIG. 4 illustrating a spline for securing the diaphragm in place on the pallet.

Means is provided for rapidly and securely fastening diaphragm 25 to the pallet in such manner as to prevent the diaphragm from becoming dislodged or partially dislodged from pallet 3 during fluidization of the load due to air pressure beneath the diaphragm from pulling it from the pallet. As previously mentioned, the outer margins of the diaphragm overlie retainer groove 33 which extends continuously around the outer perimeter of deck 15 and which outlines opening 19 (see FIG. 2). An elongate retainer spline 39 of a relatively stiff material (e.g., stainless steel or the like) having a series of serrated teeth 41 on one side thereof is inserted down into groove 33 along with diaphragm 25, with one side (i.e., teeth 41) bearing against one side face (i.e., the inner side face toward the center of deck 15) of groove 33 and with the other side of the spline bearing against the other side face of the groove. As best shown in FIG. 4, spline 39 is crimped along its entire length so that it has a generally flattened V-shaped configuration when viewed in cross-section. The spline includes base portion 42 on one side of the crimp, and teeth 41 project outwardly from the other side of the crimp (see FIG. 8). Teeth 41 are generally triangular when viewed in plan and may, for example, have a length of about 0.25 inches (0.63 cm.). Spline 39 may, for example, have about 5 teeth per inch (2 teeth per cm.). The spline further includes tabs 43 extending outwardly from the outer edge of base portion 42. These tabs may, for example, be spaced on one inch (2.5 cm.) centers and be about 3/32 inches (0.24 cm.) long. Spline 39 is inserted into groove 33 with teeth 41 pointing downwardly and toward the inner generally vertical wall of the groove with base portion 42 being parallel to and bearing against the outer generally vertical wall of the groove. Thus, the tips of teeth 41 uniformly engage the diaphragm and hold it firmly against the inner wall (bottom inner corner) of the groove. Staples 44 are preferably driven into the outer wall of groove 33 so as to engage selected tabs 43 for holding the spline in place in the groove. Upon introduction of the fluidized air into plenum 27, the air pressure acting against the diaphragm will tend to pull the diaphragm upwardly out of the groove. However, as the diaphragm begins to move upwardly out of the groove, teeth 41 which protrude at least partially through the diaphragm, move along with the diaphragm and thus more fully penetrate the diaphragm (if they have not already done so) and further are caused to dig into the plastic material constituting the inner wall of the groove. The outer edge of base portion 42 and staples 44 engaging tabs 43 constitute a fulcrum about which the spline rotates. The rotation of the spline about this fulcrum is indicated by the arrows in FIG. 4. In this manner, the spline self-locks in the groove and the application of additional tension loading to the diaphragm tends to cause the teeth to grip even more securely and thus effectively resists tension loading of the diaphragm. It will be appreciated that staples 44 are primarily for acting as a fixed fulcrum or pivot for the upper edge of the base portion as well as for holding the spline in the groove prior to the application of fluidizing air pressure to the diaphragm and that the staples are substantially free of tension loading which might tend to pull them from the pallet while the diaphragm resists the pressure force. The staples are primarily subjected to shear loading which does not tend to pull them from the pallet.

It has been found that a spline having the approximate dimensions as indicated above effectively and efficiently fastens a variety of types of diaphragms from relatively heavy canvas to a fine ripstop nylon or parachute nylon. It has also been found that the spline arrangement described above is effective in securing multiple plies of cloth constituting the diaphragm and it has been still further found that the teeth do not cut or penetrate through the diaphragm to such a degree as to degrade its strength. This method of attachment causes the diaphragm to form an air seal at the inside of groove 33 so that the small holes made in the diaphragm by the spline teeth are outside this air seal and do not leak any substantial quantity of fluidizing air. As shown in the drawings, spline 39 is substantially continuous along the length of groove 33, but it will be understood that a series of shorter lengths of the spline could be placed intermittently around the diaphragm in the groove. It will be noted that a diametric groove 33' is provided in deck 15 for receiving a spline 39 so as to secure the center of diaphragm 25 to the deck thereby to reduce the total force on the peripheral spline.

As previously mentioned, container 1 includes bag 5 which is removably and sealably secured to pallet 3. Bag 5, as heretofore described, is an elongate tubular sleeve of a tough, strong plastic film or the like. Specifically, in certain applications, plastic coated fabric film such as is commercially available from the Van Leer Plastics, Inc. of Houston, Tex. under their trademark VALERON, may be used. It will be understood, however, that a variety of different films and bag configurations may be used in conjunction with the container of this invention depending on the quantity of product to be contained in the bag, the characteristics (i.e., density, toxicity, etc.) of the product, the number of desired reuses of the container, and other parameters.

In accordance with this invention, a split hoop clamp, as is generally indicated at 45, is provided for releasably and sealably fastening bag 5 to pallet 3 so as to substantially eliminate the tendency of the bag to be pulled free of the pallet during fluidization of the load due to air pressure within the bag, and to substantially eliminate leakage of the product between the bag and the pallet. As shown in FIG. 4, pallet 3 is formed to have the above-mentioned continuous flange 13 extending circumferentially therearound. By way of example, flange 13 has a heighth of approximately $\frac{3}{4}$ inches (1.9 cm.) and extends radially outwardly from peripheral wall 11 approximately $\frac{1}{4}$ inch (0.63 cm.). In accordance with this invention, the bottom margin of tubular bag 5 is folded back on its outside face so as to form a hem 47 (see FIG. 4). A cord 49, such as a stretchable elastomeric ring, a fiber rope, or the like, is placed inside the hem below flange 13. It will be noted that the double ply of the hem extends up above flange 13. Clamp 45 is shown to comprise a hoop 51 of an electrically conductive metal, such as mild steel or the like, which is generally channel-shaped in cross section (see FIG. 4) having a web 53 adapted to be generally parallel to and to be cooperable with the outer face of flange 13 thereby to clamp bag 5 relative to the pallet. The clamp further has upper and lower flanges **55*a*, 55*b* the lower flange 55*b* extending beneath the flange 13 on the pallet and the upper flange 55*a* extending over the flange 13 on the pallet. The outer edges of these flanges are preferably bent back on themselves so as to protect the bag from being cut or otherwise damaged by the strap. It will be understood, the lower margin of a bag 5 containing an unfluidized load of fluidizable material has a tendency to droop down over the outside of clamp 51. In accordance with this invention, the upper flange 55*a* of hoop clamp 51 positively holds the bag on flange 13 of the pallet and positively prevents the weight of the fluidizable material in the bag from pushing or pulling the bag and hoop clamp 51** off the pallet.

Still further in accordance with this invention, the outer face of flange 13 may optionally have a layer of compressible foam material 56 adhered thereto. This foam material is shown to be about as wide as flange 13 and to have a thickness of about $\frac{1}{8}$ inch (0.31 cm.). The foam layer is disposed between the double plies of hem 47 and flange 13 so as to constitute a compressible surface against which the bag hem may be compressed and sealed. This foam takes up dimensional variances in the pallet and in the clamp and enables a leak-tight seal to be made within a relatively wide band of dimensional tolerances.

Figure 7:
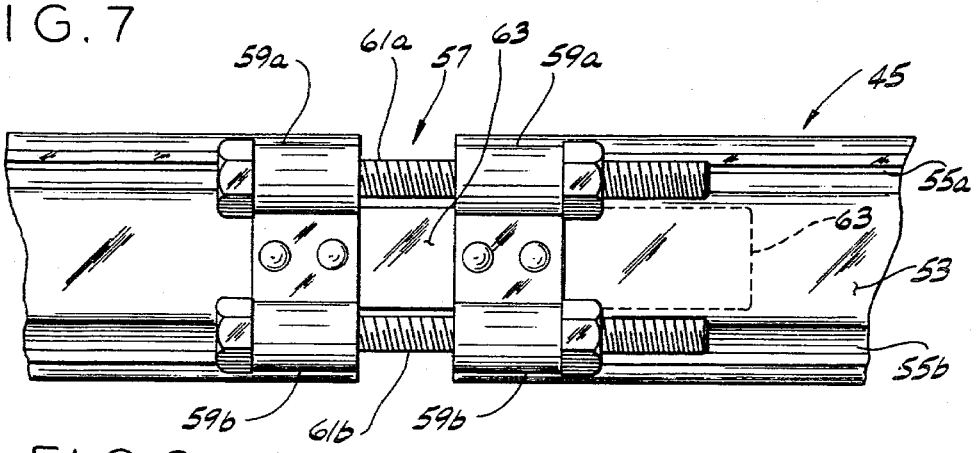
FIG. 7 is an enlarged side elevational view of the clamp of this invention for clamping the bag to the pallet.

Hoop clamp 51 further includes a tension connector, as generally indicated at 57, for adjustably drawing the ends of the clamp together and for securely clamping bag 5 on pallet 3. As shown in FIG. 7 tension connector 57 comprises a pair of upper and lower tubular barrels 59*a*, 59*b*, respectively, secured to each end of the split hoop clamp for receiving upper and lower bolts 61*a*, 61*b*. By tightening the bolts, the hoop may be tightened a desired amount within the limits of bolts 61*a*, 61*b*. By selectively tightening either the upper or lower bolts somewhat more than the other, the upper and lower flanges of the clamp may be adjusted independently of one another so as to vary the degree to which the upper and lower portion of the clamp grips the bag. The hoop further includes a resilient tongue 63 of relatively thin gauge stainless steel or the like which is secured to one end of the hoop clamp and which extends beneath the other end of the hoop clamp to protect the bag from damage (i.e., from being torn) as the hoop is tightened. While tension connector 57 has been herein described as a bolt tightening arrangement, other types of tensioning devices, such as overcenter buckles and the like, may be used.

With the above-described bag securing means of this invention, as fluidizing air enters bag 5 from plenum 27 through diaphragm 25 and as air pressure within the bag builds up so as to exert vertical tension force on the bag (thereby maintaining its shape in a semi-rigid manner) which would tend to pull it away from deck 15, any slippage of the bag relative to the hoop clamp is prevented by cord 49 after the cord comes into contact with the bottom flange 55*b* of the hoop clamp (i.e., the cord is confined below the lower flange of the clamp). Thus, the securing arrangement for the bag of this invention can be said to be self-locking and to thus positively prevent the bag from being pulled off the pallet during fluidized unloading.

After filling bag 3 with product, the upper margin or mouth of the bag is twisted or otherwise drawn shut so as to at least partially close off the mouth of the bag. As has been heretofore conventional, a length of plastic tubing 65 or the like constituting a vent for the bag is inserted in the constricted mouth of the bag and the bag is clamped, as by means of a wire tie 67 or the like so as to releasably close and seal the mouth of the bag with respect to the vent tube (see FIG. 1). Vent conduit 65, discharge outlet 19, and compressed air inlet 23 may be capped by suitable plastic caps or plugs (not shown) inserted therein so as to seal the load within container 1. Thus, upon unloading the container, the plugs are removed from the discharge outlet, the fluidizing air inlet and from the bag vent tube.

As the fluidizing air enters the bag from plenum through porous diaphragm 25, it is vented from the bag via vent tube 65 after it has flowed through the product within the bag. As heretofore mentioned, the degree of fluidization of the product or material within bag 5 may vary, depending on the quantity of product in the bag, as the product is unloaded. Also, the pressure within the bag may occasionally decrease or increase as the product is intermittently discharged from the bag. In certain instances an increase in air pressure within the bag will pull the bag free of the pallet. In other instances, a decrease in pressure within the bag below a specified level will cause an erect bag to lose rigidity and to permit the load to shift so as to cause the container to tip.

A vent valve, as generally indicated at 69, is connected to a vent valve conduit 71 which is sealably connected to vent tube 65 for venting the fluidizing air from within bag 5. Thus, vent valve 69 constitutes means for venting the fluidizing air from the bag and for maintaining air pressure within the bag within a predetermined range during fluidization of the load so as to hold the bag erect and to prevent pressure within the bag from pulling it from the pallet during fluidization of the bag. Vent valve 69 comprises a body 73 having an inlet 75 connected to vent conduit 71 and an outlet 77 with a damper or flapper valve member 79 pivotally mounted offcenter between the inlet and outlet. A counterbalancing crank arm 81 rotates with the flapper valve member and carries a counterbalancing weight 83 for biasing the flapper valve member toward its closed position in which it substantially blocks the flow of fluidizing air from the bag. Since valve member 79 is pivotally mounted offcenter, air pressure from within the bag tends to cause the flapper valve member to pivot or rotate relative to body 73 from its closed position toward its opening position against the bias of counterbalancing weight 83. The counterweight 83 being positioned to reduce its closing bias on the valve member 79 as the valve member 79 moves through a succession of positions from the flow blocking closed position to the fully open position. Thus, by adjusting the position of counterbalancing weight 83 along the length of crank arm 81, vent valve 69 can be selectively adjusted to maintain air pressure within the bag within a selected pressure range so as to insure proper fluidization of the load within the bag, to prevent the build up of excessive air pressure within the bag, and to maintain a sufficient pressure within the bag to hold the bag erect as the load is discharged therefrom. This pressure range may, for example, vary between 2 and 40 inches (5 and 100 cm.) of water. It will be understood that means other than weight 83, such as a spring, may be used to counterbalance valve member 79 against opening under the influence of fluidizing air pressure within the bag.

As previously mentioned, fluidized product from within bag 5 is discharged from the container via outlet 19. As was conventional in prior art containers, such as disclosed in the above-mentioned coassigned U.S. Pat. No. 4,007,694, the discharge conduit or hose was removably inserted into the discharge opening of the pallet so that the product discharged therefrom could be conveyed to a remote location, such as to a hopper, an educator, or the like. Heretofore, the discharge conduit of these prior art containers had a probe which was forcibly inserted into the pallet discharge opening so as to be frictionally sealed and held in place on the pallet. However, due to dimensional variances of the pallet discharge opening, due to inadvertant bumping of the discharge conduit, and due to air pressure within the discharge opening, the prior art probes would, on occasion, become dislodged from the pallet with consequent spillage of the product and termination of unloading from the container.

Figure 6:
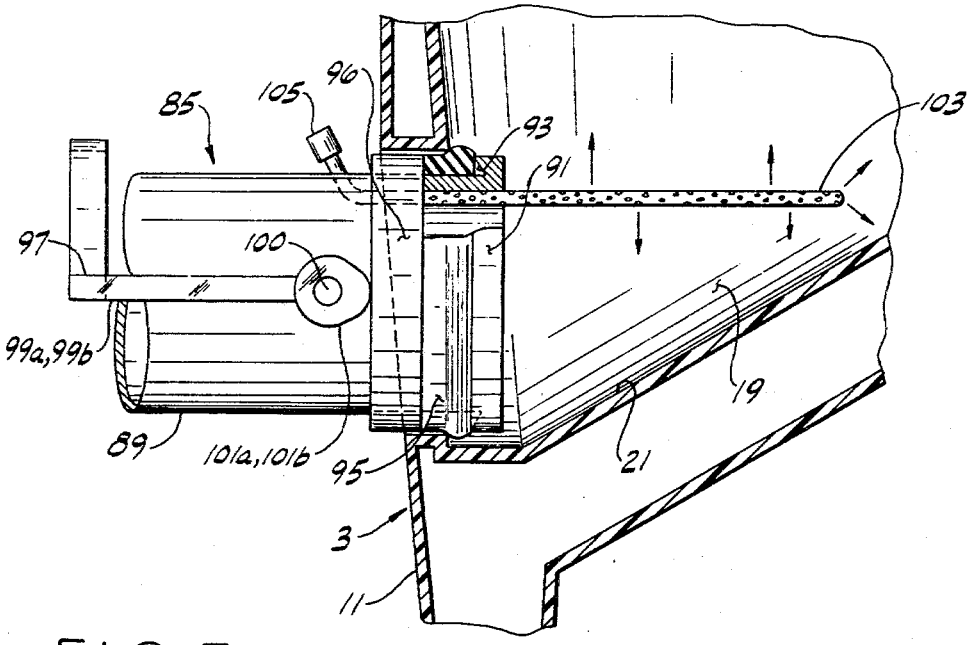
FIG. 6 is an enlarged view of a probe of this invention for being releasably and sealingly secured within the discharge opening of the pallet, the probe being shown in its sealed position.

A probe, as generally indicated at 85, is provided for insertion into and for being positively and sealingly connected to outlet opening 19 of pallet 3 of this invention so as to receive the material being discharged from the pallet. A conduit or hose 87 is secured to probe 85 for conveying the discharged material from the pallet. The probe has a tubular body 89 of circular cross section and has an outwardly extending flange 91 adjacent the outlet end of the body with the surface of the flange facing away from the end of the body constituting a shoulder 93. As shown in FIG. 6, shoulder 93 is preferably undercut for purposes as will appear. An expandible seal 95 of hard rubber, plastic or the like is positioned on the body behind shoulder 93. A compression ring 96 is located on body 89 behind the seal and is axially movable on the body between a retracted position (not shown) in which it is substantially clear of seal 95 and in which the seal is substantially free of compression and a compression position (as shown in FIG. 6) in which the ring compresses the seal between itself and shoulder 93 thereby to cause the seal to expand radially outwardly into firm gripping and sealing engagement with walls 21 defining outlet 19 of pallet 3. It will be understood that the seal fits into the undercut of shoulder 93 to hold the seal as it is compressed thereagainst. As shown in FIG. 6, the seal extends past the inner surface of peripheral wall 11 so that upon being compressed, it engages the walls of the outlet and bulges out on the inside of the peripheral wall to a diameter larger than the outlet thereby to positively prevent the probe from being withdrawn from the opening. With the seal frictionally engaging walls 21 of outlet 19, the probe firmly engages the pallet and thus prevents inadvertent removal of the probe from the pallet and the probe is effectively sealed relative to the pallet so as to prevent leakage of product from the outlet 19 during unloading. The probe further includes a handle 97 joining two cam levers 99*a*, 99*b* on opposite sides of body 89, the cam levers being pivotally secured to the body as indicated at 100. Each of the cam levers has a respective rotary cam 101*a* or 101*b* adjacent its pivotal connection. These cams cammingly engage the rear face of compression ring 96 opposite seal 95 and cause the ring to move axially along the body member toward shoulder 93 so as to move the ring toward its compression position. Handle 97 and cam levers 99*a*, 99*b* constitute manually operable means for compressing and releasing seal 95.

Probe 85 may optionally include an air tube 103 for directing air into the fluidizable material as it flows into outlet 19 from within bag 5 thereby to insure that the material will continue to flow through the outlet and will not bridge or jam in the outlet. This discharge air tube is shown to comprise a tubular member extending endwise from the top of the probe from the inside of body 89. The tubular member extends into the probe body and has external connections 105 thereon so that an air line (not shown) from a compressed air source may be connected thereto. Thus, in operation compressed air may be directed through air tube 103 and discharged into the powder within outlet 19 thereby to breakup and to keep the powdered material flowing through the outlet. Compressed air for air tube 103 may optionally be applied by a bypass from the fluidizing air line adapted to be inserted in inlet 23.

Figure 9:
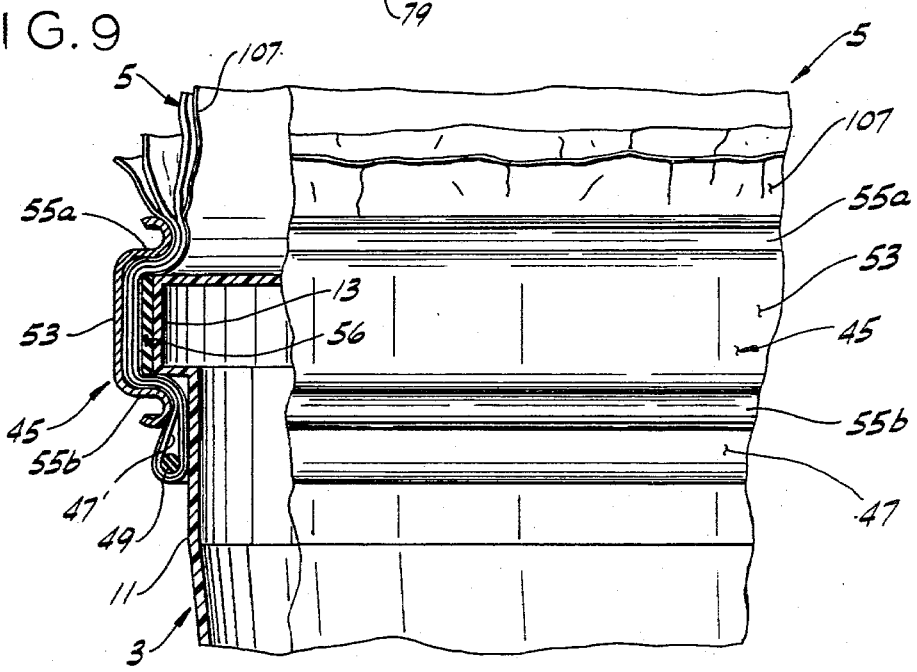
FIG. 9 is a view similar to FIG. 4 illustrating a modification of the container of this invention incorporating an electrically conductive liner within the bag.

In handling certain products which pose a risk of explosion or fire, or in handling relatively safe materials in a hazardous environment (such as in a hydrocarbon environment in a chemical plant or the like) it is necessary that the container 1 of this invention be properly grounded so as to lessen the danger of the discharge of static electricity which could cause an explosion or fire. Bag 5 may be made electrically conductive either by placing an electrically conductive liner 107 inside bag 3 or by providing an electrically conductive coating 109 on the inside surface of the bag. For example, liner 107 may be of an electrically conductive plastic film such as is commercially available from the 3M Company of Minneapolis, Minn. under their registered trademark VELOSTAT. As shown in FIG. 9, liner 107 is placed inside bag 5 so as to form a multiply bag and the liner and the bag are folded up to form hem 47'. Clamp 45 contacts liner 107 to make good electrical contact therewith. The plastic film constituting bag 5 may be made electrically conductive by electrodepositing a layer of aluminum or other electrically conductive metal on one face (the inside face) of bag 5 so as to constitute coating 109 (see FIG. 4). Such coating of plastic film is commercially available from the above-noted supplier of bag 5.

In forming hem 47 at the bottom margin of the bag, the electrically conductive inner face 109 of the bag faces outwardly when folded to form the hem and thus the electrically conductive metallic hoop clamp makes good electrical contact with the conductive surface of the bag around its entire bottom portion. Regardless of whether an electrically conductive bag or a liner 107 is used, a grounding wire 111 (as shown in FIG. 1) is clipped onto clamp 45 thereby to electrically ground the bag during filling, unloading, and other operations so as to dissipate static electric charges on the bag.

It is sometimes necessary to electrically ground vent conduit 71 and discharge conduit 87 so as to further prevent the discharge of static electricity. These conduits may be made of electrically conductive hose material, such as is commercially available from the 3M Company under their registered trademark VELOSTAT. Of course, these electrically conductive conduits may be properly grounded by connecting grounding wires (not shown) to the conduits. Thus, the entire container 1 of this invention may be effectively and readily grounded.

In handling potentially explosive or flammable materials, it may be desirable to fluidize the material during unloading with a gas other than air. For example, an inert or chemically inactive gas, such as nitrogen or the like, may be used in place of compressed air thereby to even further diminish any likelihood of fire or explosion during unloading.

It will be understood that an outlet for the discharge or vacuum withdrawal of fluidizable material within container 3 may be provided by inserting a tube (not shown) into bag 5 from the top and sucking on this tube. Of course, this withdrawal tube is sealed relative to the bag and the bag is vented to the atmosphere.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A pallet for supporting a load of granular, particulate, powdered or other fluidizable material and for fluidizing the load for unloading it from the pallet, said pallet comprising:

a plurality of legs engageable with the ground for supporting the pallet and the load, said legs being spaced for accommodating the tines of a forklift vehicle to facilitate forklift transport of the pallet and said load;

an upwardly facing deck for supporting said load, said deck sloping downwardly toward one side of the pallet;

a peripheral wall extending around the pallet joining the said upper deck and said legs;

a porous diaphragm overlying said deck and defining a plenum between said diaphragm and said deck;

an inlet adapted for the introduction of air under pressure into said plenum for fluidizing the load bearing on said porous diaphragm; and an outlet extending through said peripheral wall for communication from the space above said porous diaphragm to the exterior of the pallet, said outlet having an inner end disposed at said one side of said pallet adjacent an edge of said deck and being generally flush with said deck, said outlet angling downwardly from its innner end whereby said fluidized load flows down said inclined deck toward the inner end of said outlet and thence down said outlet;

and further comprising means for sealably securing a bag of limp synthetic resin film, coated fabric, or the like to said pallet and for preventing air pressure from within said bag present during fluidization of said load from pulling said bag from said pallet, said peripheral wall having an outwardly projecting flange therearound, said bag having a hem on its bottom end and a limp cord within said hem, said bag being adapted to fit over the outside of said flange with said cord disposed below said flange, said securing means comprising a hoop clamp extending around said pallet and fitting over said flange on the outside of said bag, said hoop clamp being channel shaped in cross section and having a generally vertical web and radially inwardly projecting upper and lower flanges, the lower flange of the hoop clamp extending beneath the flange on the pallet, the upper flange of the hoop clamp extending over the flange on the pallet for preventing the weight of the fluidizable material from pushing the hoop clamp down past the flange of the pallet, said securing means further comprising means for circumferentially and adjustably tightening said hoop clamp on said bag and on said flange on the pallet for clamping said bag to said pallet in sealing engagement whereby upon pressurization of said bag and upon said bag being pulled upwardly relative to the pallet, said cord is confined below the lower flange of the clamp and prevents the bag from being pulled off the pallet.

2. A pallet as set forth in claim 1 wherein said means for circumferentially tightening said clamp includes means for adjustably tightening the upper and lower flanges of said clamp independently of one another within a limited range.

3. A pallet as set forth in claim 2 wherein said hoop clamp is split and wherein said adjustable tightening means comprises a pair of threaded fasteners interconnecting the ends of said split hoop clamp for drawing the hoop clamp ends together.

4. A pallet as set forth in claim 1 wherein the upper and lower flanges of the hoop clamp are bent back on themselves so as to protect the bag from being cut by the hoop clamp.

5. A pallet as set forth in claim 1 further including compressible seal means interposed between said flange on the pallet and said hoop clamp whereby upon tightening said hoop clamp said compressible means accommodates dimensional variances in said flange on the pallet and said hoop clamp so as to insure said hoop clamp sealingly clamps said bag to said pallet.

6. A pallet as set forth in claim 5 wherein said compressible material is a synthetic resin foam material secured to said flange on the pallet.

7. A container for transporting and storing a load of granular, powder, particulate, or other fluidizable material and for fluidized unloading of the load therefrom, said container comprising a pallet adapted for forklift transport of the container and the load, a bag of synthetic resin film or the like secured to said pallet defining a storage space for containing said load, porous means defining the bottom of said storage space for fluidizing said load upon introduction of compressed air into said storage space through said porous means for the discharge of fluidized material therefrom, and means for sealably securing said bag to said pallet for preventing air pressure from within said bag present during fluidization of the load from pulling said bag from the pallet, said pallet having a continuous outwardly projecting flange therearound, said bag having a hem on its lower end and a cord within said hem, said bag being adapted to fit over the outside of the flange with said cord disposed below said flange, said securing means comprising a hoop clamp fitting over said flange on the outside of said bag, said hoop clamp being channel shaped in cross section and having a generally vertical web and radially inwardly projecting upper and lower flanges, the lower flange of the hoop clamp extending beneath the flange on the pallet, the upper flange of the hoop clamp extending over the flange on the pallet for preventing the weight of the fluidizable material from pushing the hoop clamp down past the flange on the pallet, said securing means further comprising means for circumferentially and adjustably tightening said clamp on the bag and on the pallet for clamping said bag to said flange on the pallet in sealing engagement whereby upon pressurization of said bag during fluidization of said load and upon said bag being pulled upwardly relative to the pallet, said cord is confined below the lower flange of the hoop clamp and prevents the bag from being pulled off the pallet.

8. A container as set forth in claim 7 wherein said means for circumferentially tightening said clamp includes means for adjustably tightening the upper and lower flanges of the clamp independently of one another within a limited range.

9. A container as set forth in claim 8 wherein said hoop is split and wherein said adjustable tightening means comprises a pair of threaded fasteners interconnecting the ends of said split hoop for drawing the hoop ends together.

10. A container as set forth in claim 7 wherein said hoop is split and wherein one end of said split hoop carries a tongue extending endwise therefrom adapted to underlie the other end of said hoop whereby upon tightening said tightening means said other end of said hoop slides on said tongue without damage to said bag.

11. A container as set forth in claim 7 wherein said cord is a stretchable elastomeric ring.

12. A container as set forth in claim 7 wherein the upper and lower flanges of the hoop clamp are bent back on themselves so as to protect the bag from being cut by the hoop clamp.

13. A container for transporting and storing a load of granular, powder, particulate, or other fluidizable material and for fluidized unloading of the load therefrom, said container comprising a pallet adapted for forklift transport of the container and the load, a bag of synthetic resin film or the like secured to said pallet defining a storage space for containing said load, porous means defining the bottom of said storage space for fluidizing said load upon introduction of compressed air into said storage space through said porous means for the discharge of fluidized material therefrom, and means for sealably securing said bag to said pallet for preventing air pressure from within said bag present during fluidization of the load from pulling said bag from the pallet, said pallet having a continuous outwardly projecting flange therearound, said bag having a hem on its lower end and a cord within said hem, said hem being adapted to fit over the outside of said flange, said securing means comprising a hoop clamp fitting over said flange on the outside of said hem and means for circumferentially tightening said clamp on the hem and on the pallet for sealingly clamping said bag to said pallet whereby upon pressurization of said bag during fluidization of said load and upon said bag being pulled upwardly relative to the pallet, said cord engages the hem at said clamp and prevents the bag from slipping relative to the clamp, said container further including compressible seal means interposed between said flange and said clamp whereby upon tightening said clamp said compressible means accommodates dimensional variances in said flange and said clamp so as to insure that said clamp sealingly clamps said bag to said pallet.

14. A container as set forth in claim 13 wherein said compressible material is a synthetic resin foam material secured to said flange.

* * * * *